US008627971B2

(12) United States Patent
Lancaster et al.

(10) Patent No.: US 8,627,971 B2
(45) Date of Patent: Jan. 14, 2014

(54) ACCESS SHIELD FOR SHIPPING CONTAINER

(75) Inventors: Ronald R. Lancaster, Rockwall, TX (US); Philip N. Chivers, Plano, TX (US); Mark A. Chivers, McKinney, TX (US); Michael R. Custer, Heath, TX (US)

(73) Assignee: ABG Tag & Traq, LLC, Oklahoma City, OK (US)

( * ) Notice: Subject to any disclaimer, the term of this patent is extended or adjusted under 35 U.S.C. 154(b) by 80 days.

(21) Appl. No.: 13/065,607

(22) Filed: Mar. 28, 2011

(65) Prior Publication Data

US 2012/0248100 A1 Oct. 4, 2012

(51) Int. Cl.
*B65D 88/00* (2006.01)

(52) U.S. Cl.
USPC ..... 220/1.5; 220/731; 220/730; 220/729; 292/259 R; 410/121; 410/99; 410/94; 410/80

(58) Field of Classification Search
USPC ..... 220/1.5, 730–731, DIG. 21; 410/35, 94, 410/121, 40–41, 80, 99; 206/453, 586; 292/259 R, 338–339, 288–289, 300, 292/DIG. 15, DIG. 65
IPC ..... B65D 55/00,55/02, 88/00, 90/54
See application file for complete search history.

(56) References Cited

U.S. PATENT DOCUMENTS

| | | | | |
|---|---|---|---|---|
| 1,675,701 | A * | 7/1928 | Fitch | 410/94 |
| 1,897,138 | A * | 2/1933 | North | 410/99 |
| 4,092,933 | A | 6/1978 | Charlton | |
| 4,669,767 | A * | 6/1987 | Leto | 292/259 R |
| 4,701,087 | A * | 10/1987 | Cain et al. | 410/94 |
| 4,854,791 | A | 8/1989 | Brown | |
| D346,321 | S * | 4/1994 | Pearson | D8/346 |
| 5,437,390 | A * | 8/1995 | Romick | 220/768 |
| 6,364,584 | B1 | 4/2002 | Taylor | |
| 6,378,917 | B1 * | 4/2002 | Jones | 292/42 |
| 6,412,835 | B1 * | 7/2002 | Patterson | 292/259 R |
| 7,661,733 | B1 * | 2/2010 | Angel | 292/259 R |
| 7,862,268 | B2 * | 1/2011 | Dibner | 410/121 |

* cited by examiner

*Primary Examiner* — Mickey Yu
*Assistant Examiner* — Brijesh V. Patel
(74) *Attorney, Agent, or Firm* — William M. Hobby, III

(57) ABSTRACT

The present invention is for an access shield for a shipping container, which container has a pair of doors and a plurality of supporting feet. An access shield for the shipping container is placed under the door end of the shipping container and is contained by the shipping container's weight with a pair of locking arms positioned behind the shipping container's feet to block access into a shipping container.

8 Claims, 2 Drawing Sheets

ACCESS SHIELD FOR SHIPPING CONTAINER

BACKGROUND OF THE INVENTION

The present invention relates to security in shipping containers and more particularly to an apparatus for barring access to a shipping container.

Shipping containers are used to move materials by ship, truck and train. These containers are provided in various lengths to fulfill a broad range of shipping needs. Access to the interior of shipping containers is gained through a pair of doors located in one end of the container and which doors open outwardly. Each door is hinged to the outside edge of the door. Each shipping container door normally has a set of vertical bars placed in front of the door. These bars may be rotated to engage their camlocks and then locked with a padlock. Padlocks however are easily defeated by a grinder, torch or other burglary tool or by use of a key in the possession of those who are not authorized to enter the shipping container. Thus, while the prior art teaches the use of padlock bars for inhibiting access to the storage container, additional security measures are needed to prevent theft from the storage containers.

Prior art U.S. patents which provide additional security means for access to shipping containers includes the Taylor U.S. Pat. No. 6,364,584 for an access bar for a shipping container. This patent is directed towards means to prevent theft from storage containers while they are in transit and provides a blocking apparatus having a pair of legs joined to form a generally L-shaped elongate member in which one of the legs provides spaced apart apertures. Each aperture then fits over a container locking device having a lower cleat which mounts in a hole in a mounting bracket in each corner of a flatbed truck. One of the pair of elongated legs is then positioned under the end of a shipping container so that the other leg of the L-shaped elongated member protrudes above the doors to prevent entry into the doors.

In the Charlton U.S. Pat. No. 4,092,933, a brace is provided for securing the doors of cargo containers being transported on a railway flat car and having end doors that are commonly subjected to forceful opening. The apparatus is handedly attached to a freight car floor and may be folded downwardly into a stowed position but has an upstanding member integrally attached thereto which is raised to block entry into the freight car. A forward biasing component extends between the base member and the supporting floor for forcibly directing the upstanding member against the containerized doors.

In U.S. Pat. No. 4,854,791 to Brown, a container door barricade is for use on a railroad container car having one or more freight decks adapted to carry containers of different lengths. The door barricade may include a plurality of fixed and pivotal barricade assemblies having one or more rotatable Z-shaped plates interconnected by linkage to provide means for simultaneously rotating the Z-shaped plates from either side of the freight vehicle.

The present invention is for an access shield for a shipping container, which container has a pair of doors and a plurality of supporting feet. An access shield for the shipping container is placed under one end of the shipping container and is supported by the shipping container's weight with a pair of locking arms positioned behind the shipping container's feet to block access into a shipping container.

SUMMARY OF THE INVENTION

The present invention is an access shield for a shipping container which shipping container has a pair of end doors and a plurality of supporting feet. The access shield has an elongated flat base having a generally upright door shield attached thereto. The base has a protruding arm on each end thereof with each arm being sized to fit behind one foot of a shipping container when the base is placed under the door end of the shipping container. An upright door shield attached to the base is positioned to extend over a portion of the shipping container pair of doors when the base is placed under the door end of the shipping container so that the doors of the shipping container are blocked from being open. Thus an access shield for a shipping container placed under the door end of the shipping container and supported by the shipping container's weight having a pair of protruding arms positioned behind the container's feet holds a door shield over the shipping container's pair of doors to block access to the shipping container. The protruding arms on the end of the base form a generally L-shape on each end of the flat base while the generally upright door shield is attached to the base on one edge of the base so that when the base is positioned below the shipping container, the door shield extends in front of the doors. The upright door shield has an aperture therethrough for use in storing the door shield.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
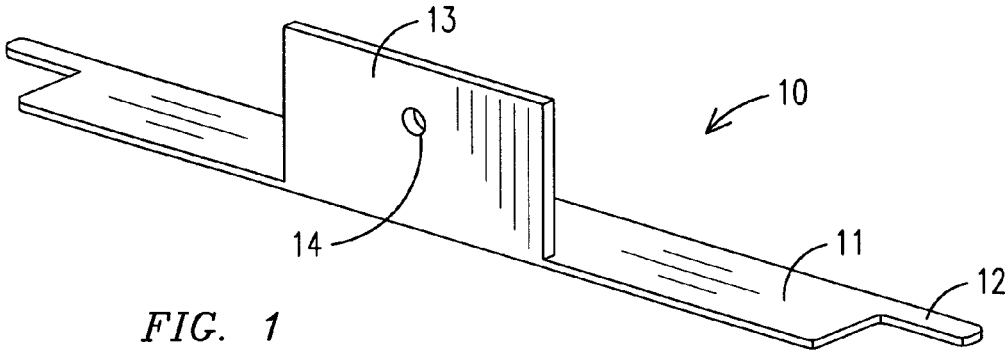
FIG. 1 is a perspective view of an access shield for a shipping container in accordance with the present invention.

Referring to the drawings of FIGS. 1-4, an access shield 10 for a shipping container has an elongated flat base 11 which is a generally horizontal flat plate having a protruding arm 12 on each end thereof. The protruding arm is formed by a recess being cut into the flat base 11 to form a generally L-shaped base end. The protruding arm 12 is a locking arm and the base 11 has a door shield 13 which is generally an upright door shield or metal shield plate which extends generally perpendicular to the flat base 11. The door shield 13 has an aperture 14 in the center thereof. The door shield can be seen as being attached to the base 11 in the center of the elongated surface thereof.

Figure 2:
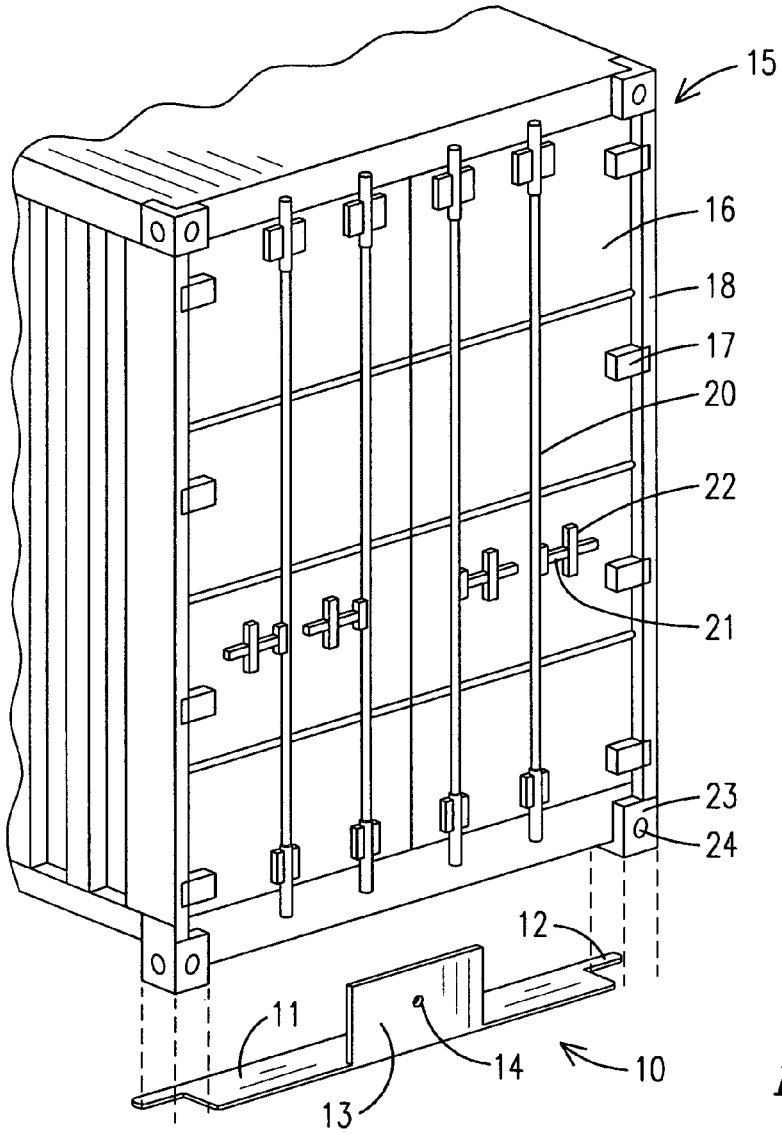
FIG. 2 is an exploded perspective of an access shield of FIG. 1 being positioned under a shipping container.
Figure 3:
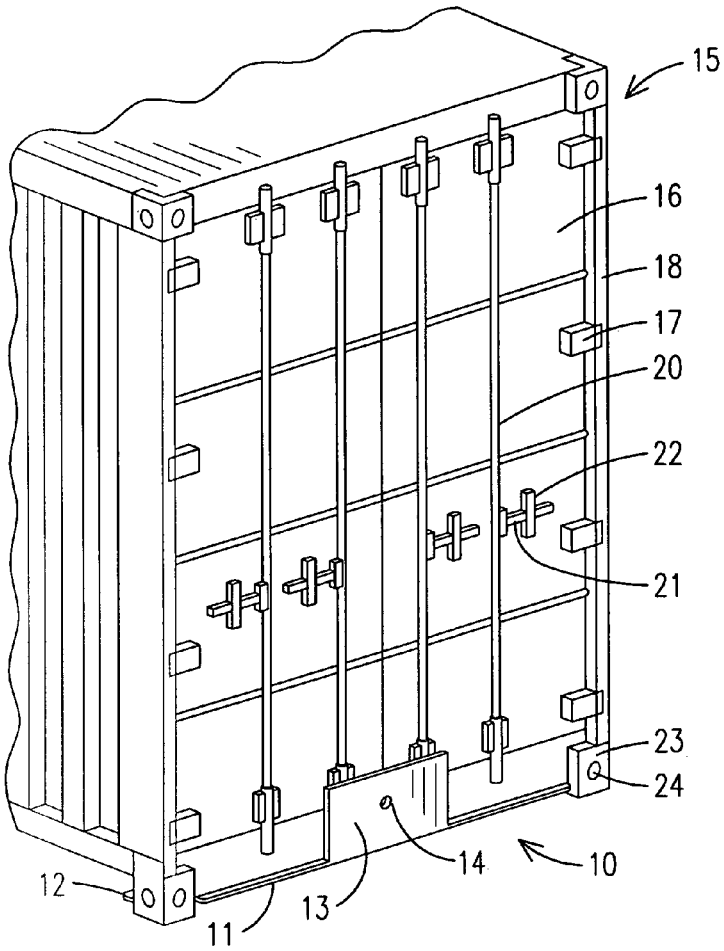
FIG. 3 is a perspective view of the access shield and positioned for blocking access into the shipping container.
Figure 4:
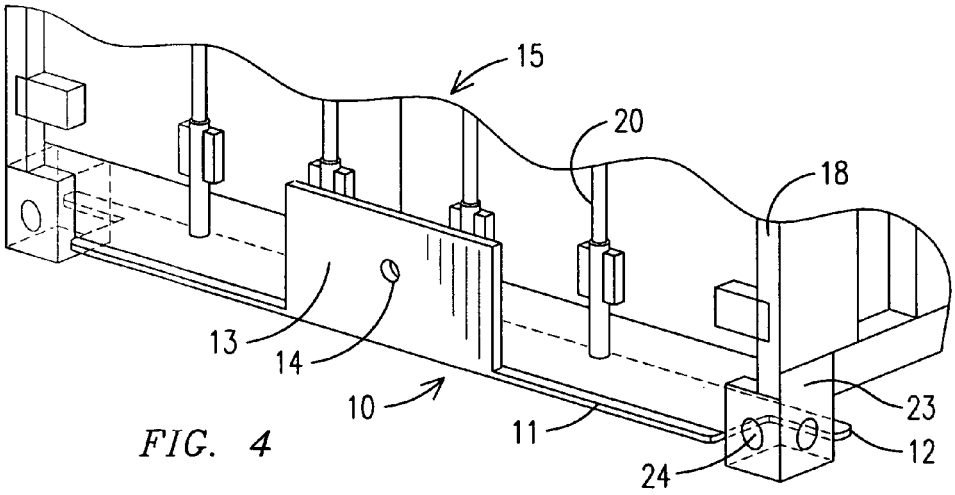
FIG. 4 is a partial perspective of the access shield of FIGS. 1-3 positioned under the shipping container.

In a typical shipping container 15, as seen in FIGS. 2-4, a pair of generally rectangular doors 16 are hinged with hinges 17 to the shipping container frame members 18. The shipping container also has a plurality of vertical locking rods 20 which can be held in place by their handles 21 and locking members 22. The shipping container 15 has a plurality of shipping container feet 23. Generally there would be one foot 23 on each corner of the shipping container. Each foot might have an opening 24 extending thereinto.

In operation, the access shield 10 is positioned under the door end of the shipping container 15, as seen in FIGS. 2, 3 and 4, and has the protruding or locking arms 12 fitting around the feet 24 of the shipping container. The shipping container is lowered onto the mating feet bosses of the transport vehicle. This captures and contains the access shield 10 in the clearance gap created by the feet and their bosses. The weight of the shipping container prevents it from being pried up to release the access shield.

In FIGS. 3 and 4, the access shield is located in the gap created by the feet and their bosses with the protruding arms 12 extending behind the feet 23. The upright door shield 13 extends in front of the shipping container doors 16 so that the doors 16 cannot be open without lifting the shipping container and removing the access shield 10. Inasmuch as shipping containers are, at this point, loaded with cargo, the shipping container cannot be readily lifted.

A simplified shipping container door shield 10 provides additional security to prevent the shipping container doors from being opened. Shipping containers normally have padlocks attached thereto but padlocks can be opened by cutting the locks with grinders or torches or keys. If the padlocks are opened or broken, the container 15 is still secured by the present shipping container access shield.

It should be clear at this point that an access shield for a shipping container having a pair of doors and a plurality of support feet has been provided with added security for securing the shipping container doors. However, the present invention is not to be construed as limited to the forms shown which are to be considered illustrative rather than restrictive.

We claim:

1. A shipping container and access shield comprising:

a shipping container having a door end having a pair of end doors and a plurality of supporting feet; and an access shield having a generally horizontal base having two ends and having a generally upright door shield extending therefrom and positioned between the ends thereof, said base having an elongated, protruding arm on each end thereof, each elongated protruding arm being sized to fit behind one of said supporting feet of said shipping container when said base is placed under the door end of said shipping container with each elongated protruding arm and respective base end further forming a L-shaped base end, and said upright door shield is positioned to extend over a portion of the shipping container pair of doors when said base is placed under the door end of the shipping container;

whereby an access shield placed under the door end of the shipping container is contained by the shipping container's weight and a pair of elongated protruding arms positioned behind a pair of shipping container feet to position the door shield in front of the shipping container pair of doors to block access into the shipping container.

2. The access shield for a shipping container in accordance with claim 1 in which said generally upright door shield is positioned on one edge of said base.

3. The access shield for a shipping container in accordance with claim 2 in which said generally upright door shield is positioned between the ends of said base and generally centered thereon.

4. The access shield for a shipping container in accordance with claim 3 in which said generally upright door shield has an aperture therethrough.

5. A shipping container and access shield comprising:

a shipping container having a door end having a pair of end doors and a plurality of supporting feet; and an elongated metal shield plate having a generally horizontal flat plate having a recessed area on each end thereof forming an elongated protruding locking arm on each end of said generally horizontal flat plate, said generally horizontal flat plate being shaped to fit under the door end of said shipping container with each elongated protruding locking arm extending behind one of said supporting feet of said shipping container and the respective end of said generally horizontal flat plate further forming a L-shaped base end and said elongated metal shield plate having an access shield plate extending generally vertically from said generally horizontal flat plate and positioned to extend in front of said shipping container pair of doors;

whereby an access shield placed under one end of the shipping container is held by the shipping container's weight and by the pair of elongated protruding locking arms positioned behind the shipping container's feet to block access into the shipping container.

6. The access shield for a shipping container in accordance with claim 5 in which said access shield plate is positioned on one edge of said generally horizontal plate.

7. The access shield for a shipping container in accordance with claim 6 in which said access shield plate is positioned between the ends of said generally horizontal plate and generally centered thereon.

8. The access shield for a shipping container in accordance with claim 7 in which said access shield plate has an aperture therethrough.

* * * * *